US012359383B2

(12) United States Patent
Hoffmann et al.

(10) Patent No.: US 12,359,383 B2
(45) Date of Patent: Jul. 15, 2025

(54) EXPANSION-JOINT BRIDGING DEVICE

(71) Applicant: Mageba Services & Technology AG, Buelach (CH)

(72) Inventors: Simon Hoffmann, Constance (DE); Peter Mense, Rorbas-Freienstein (CH); Volker Kessler, Constance (DE); Gianni Moor, Sils'Maria (CH)

(73) Assignee: Mageba Services & Technology AG, Buelach (CH)

( * ) Notice: Subject to any disclaimer, the term of this patent is extended or adjusted under 35 U.S.C. 154(b) by 661 days.

(21) Appl. No.: 17/824,490

(22) Filed: May 25, 2022

(65) Prior Publication Data

US 2022/0282434 A1 Sep. 8, 2022

Related U.S. Application Data

(63) Continuation of application No. PCT/EP2020/083200, filed on Nov. 24, 2020.

(30) Foreign Application Priority Data

Nov. 27, 2019 (DE) ..... 10 2019 132 189.1

(51) Int. Cl.
*E01D 19/06* (2006.01)

(52) U.S. Cl.
CPC ..... *E01D 19/062* (2013.01)

(58) Field of Classification Search
CPC ..... E01D 19/06; E01D 19/062; E01D 19/065
(Continued)

(56) References Cited

U.S. PATENT DOCUMENTS 5,887,308 A * 3/1999 Walter ..... E01D 19/062 404/69
5,964,069 A * 10/1999 Schmidt ..... E01D 19/06 52/573.1

(Continued)

FOREIGN PATENT DOCUMENTS

AT 328 494 B 3/1976
DE 19705531 A1 * 8/1998 ..... E01D 19/062

(Continued)

OTHER PUBLICATIONS

International Search Report issued by the European Patent Office for corresponding International Patent Application No. PCT/EP2020/083200, mailed on Jan. 22, 2021.

*Primary Examiner* — Gary S Hartmann
(74) *Attorney, Agent, or Firm* — Myers Wolin, LLC

(57) ABSTRACT

An expansion joint bridging device in the form of a plate-type roadway joint which bridges an expansion joint between two building components. The expansion joint is spanned by crossbeams which are braced in a load-bearing relationship on both building components. Supported on the crossbeams is at least one plate disposed above the cross-beams, the plate having two plate portions which lie flush with one another and are interconnected in a force-transmitting relationship. The plate portions are connected in situ by means of at least one cover plate which bridges the joint between the plate portions and connects the two plate portions in a force-transmitting relationship. At least one of the connections between the cover plate and the plate portions is hinged, having a rotational degree of freedom about an axis extending horizontally transversely to the orientation of the relevant plate.

13 Claims, 5 Drawing Sheets

(58) Field of Classification Search
USPC ..... 14/73.1, 73.5; 404/69
See application file for complete search history.

(56) References Cited

U.S. PATENT DOCUMENTS

| | | | | |
|---|---|---|---|---|
| 7,252,454 | B2 * | 8/2007 | Bradford | E01D 19/062 14/73.1 |
| 2008/0148499 | A1 * | 6/2008 | Bradford | E01D 19/062 14/73.5 |

FOREIGN PATENT DOCUMENTS

| | | | |
|---|---|---|---|
| DE | 10 2017 105 092 | A1 | 9/2018 |
| EP | 2 940 225 | A1 | 11/2015 |
| JP | H11-200310 | A | 7/1999 |

* cited by examiner

EXPANSION-JOINT BRIDGING DEVICE

CROSS REFERENCE TO RELATED APPLICATIONS

This application is a continuation under 35 U.S.C. § 120 of International Application PCT/EP2020/083200, filed Nov. 24, 2020, which claims priority to German Application No. 10 2019 132 189.1, filed Nov. 27, 2019, the contents of each of which are incorporated by reference herein.

FIELD OF THE INVENTION

The present invention relates to an expansion-joint bridging device in the form of a plate-type roadway transition, which bridges over an expansion joint present between two edifice parts of a drivable edifice. This expansion joint is spanned by at least three cross members, which are braced in load-bearing relationship on both edifice parts, wherein at least one of the load-bearing bracing elements permits a shifting movement of the respective cross member relative to the edifice part in question, and wherein at least one plate disposed above the cross members is braced on the cross members.

BACKGROUND

Expansion joints are indispensable in diverse edifices, in order to prevent heat-induced expansions from leading to damage to edifice parts. To bridge over such expansion joints in order to make them drivable, expansion-joint bridging devices configured in various ways are known. The plate-type bridging devices mentioned in the introduction represent one widely used design. In the case of bridging devices that are particularly large relative to the extension direction of the plates, it is then often impossible to construct the plates in one piece, since appropriately long multiple plates can be procured, further processed and transported only by tolerating major and expensive difficulties, so that in these cases the plates are first assembled in situ on the construction site from several shorter plate portions. The butt joints resulting from this approach are usually welded between the individual plate portions.

Diverse requirements, some in conflict with one another, are imposed in practice on expansion-joint bridging devices. Definitive aspects in this sense are in particular high functional safety and reliability, low noise generation during passage of traffic over the expansion joint, long useful life even under extreme service conditions (frost, de-icing salt, heavy-load traffic), low manufacturing, installation and maintenance costs as well as minimum impairment of traffic during installation, maintenance and replacement of the bridging device.

Expansion-joint bridging devices of the type described in the introduction have proved effective in practical service for many years and are known from EP 2940225 A1, for example, as well as from DE 102017105092 A1.

SUMMARY

An object underlying the present invention is to provide a bridging device of the type described in the introduction, which is characterized by even further improved practical utility, with particular focus on reduction of the manufacturing, installation and maintenance costs as well as on enhancement of functional safety, reliability and useful life with simultaneous reduction of impairment of traffic during installation, maintenance and replacement.

This object is achieved in a bridging device of the type described in the introduction that comprises plates of two plate portions joined flush with one another in mutual force transmitting relationship and the joining of the plate portions in situ by means of at least one strap bridging over the butt joint present between the plate portions and joined in force transmitting relationship with both plate portions. At least one of the joints of the strap with the plate portions is constructed with the ability to pivot with one rotational degree of freedom around an axis extending horizontally and transversely relative to the orientation of the plate in question.

Due to the renunciation of the common practice of welding the butt joint present between two plate portions to be joined on the construction site in favor of pivot joint of two plate portions according to embodiments of the present invention, an entire series of advantages relevant to practice can be achieved:

By virtue of the at least unilaterally but preferably bilaterally (see below) pivot joint with the two respective plate portions, an alternating transient action of the plate portions with one another around the axis extending horizontally and transversely relative to the orientation of the plate in question is ruled out. In this way, fatigue fracture, as can be observed in butt joints welded in situ but exposed dynamically to high loads, is ruled out. To this extent, one factor is that the manufacture of a welded seam with good workmanship quality under the conditions prevailing regularly on the construction site is extremely problematic; this is due not only to the very limited space conditions—two plates adjacent to one another in cross-member direction can typically be brought to a spacing of approximately 10 cm, sometimes necessitating special welding techniques (Secheron techniques)—but also to the ambient conditions, which are controllable to only a limited extent (see below). Incidentally, the joining of two plate portions by meams of straps is much less time-consuming than joining by means of welding, provided that implementation during construction is similar (e.g. by means of screwed-in threaded bolts). The resulting time savings, which becomes greater as the number of plates increases, is directly reflected in reduced installation costs. The technique of welding of two plate portions is indeed entirely common, albeit—especially in the construction site environment—susceptible to defects and therefore often the starting point for later failure of the corresponding joint and consequential expensive maintenance and replacement actions, due to only inadequately controllable ambient conditions (temperature, dust, humidity) as well as only very limited accessibility of the weld area; thus, by renounciation of butt joints welded in situ, it is possible to increase the reliability, the functional safety and the useful life of the bridging device.

At this place it must be pointed out that, for reasons of readability at some places, the reference to a minimum number has been omitted, even in all further subsequent references, in the case of components for which the first reference was made to the said minimum number.

Obviously the minimum number of a component defined in the first reference will be equally valid for all subsequent references thereto, even when the explicit statement is left out.

According to a first preferred further development of the invention, the bridging device is characterized in that both joints of the strap with the plate portions are made with the ability to pivot with respectively one rotational degree of freedom around mutually parallel axes. Due to the pivot construction of both joints of the strap with plate portions, several advantages can be made possible: Thus, for example, alternating transmission of vertical forces between the two plate portions in question is restricted; this is of advantage in turn with respect to a reduced risk of failure due to fatigue of bridging devices exposed dynamically to high loads. Incidentally, both plate portions may be designed identically in the region of their joint with the strap, which makes their construction and manufacture simpler and thus more favorable. Beyond this, the said identicality of both plate portions in the region of binding to the strap makes it possible to mount and demount the two plate portions in any desired order, which increases the flexibility during implementation of installation and maintenance tasks and thus may reduce effort and costs.

Another preferred further development of the inventive bridging device is characterized in that the butt joint in vertical projection overlaps with one of the cross members. Since both plate portions in the immediate vicinity of the butt joint are therefore braced on a (common) cross member, the plate portions do not execute any vertical movements relative to one another. The dynamic stress and strain on the joint of the two plate portions is further decisively reduced hereby; the failure safety benefits from this. The resulting smaller load on the individual plate portions, the strap and its joint with the plate portions contributes to an increase of the reliability, of the functional safety and of the useful life, with all of the positive economic implications.

A particularly preferred further development of the invention is characterized in that the cross member overlapping with the vertical projection of the butt joint is constructed as a double cross member. It is broader than the usual cross members and in particular may preferably consist of two profile sections welded with one another, such as from the other cross members. In this embodiment, the advantages mentioned in the foregoing in connection with a butt joint overlapping a cross member in vertical projection are quite particularly evident.

According to another preferred further development of the inventive bridging device, this is characterized in that the two plate portions are additionally joined to one another by means of a curved bracket, which engages around the bottom of the cross member provided underneath the butt joint. This curved bracket, acting as an anti-lifting safeguard, prevents the plate from being lifted up from the cross member as a result, for example, of recoil effects, which may occur in connection with the passage of traffic over the plate. Because the plate is prevented from lifting up and causing a striking effect on the way back, the noise generation during passage of traffic over the bridging device can be reduced, as can the mechanical load on the plate. The latter is manifested by an increase of the reliability, of the functional safety and of the usefuf life and thus it has positive effects on the maintenance costs. This construction of the anti-lifting safeguard as the curved bracket joining the two plate portions with one another has yet a further advantage: Via the curved bracket, tilting moments, which occur due to the rotation of the individual plate portions around their longitudinal axis (and, for example, are caused by vehicles as they accelerate/decelerate while traveling over the plates), can be transmitted from one plate portion to the adjoining other plate portion, as can vertical forces. Thereby the forces acting on the joint between strap and plate portions are reduced, which is reflected in an increase of the reliability, of the functional safety and of the useful life of the bridging device.

In a particularly preferred further development, the inventive bridging device is characterized in that at least one sliding spring acts between the curved bracket and the cross member engaging around it. The spring force transmitted from the sliding spring to the cross member and the curved bracket causes the plate to rest without clearance on the cross member, even when—due to the elasticity of the sliding spring—the spacing between curved bracket and cross member grows due to the frictional attrition that occurs in normal operation. In this way, the plates can be prevented, over the entire useful life, from lifting up from the cross member and striking it on the way back, which is reflected positively in less noise generation as well as smaller mechanical load on the plate.

An alternative further development of the inventive bridging device is characterized in that an L-shaped anti-lifting safeguard is joined with at least one of the plate portions, such that it engages under the cross member located closest to the butt joint and bracing the plate portion in question. This L-shaped anti-lifting safeguard prevents—in a manner similar to that of the already described curved bracket—lifting up of the plate from the cross member, with the positive effects, already mentioned in the foregoing, on noise generation as well as the mechanical load on the plate. When the most extensive possible decoupling of the two plate portions is desired, the use of an L-shaped (in comparison with a curved bracket-shaped) anti-lifting safeguard may be advantageous.

In a particularly preferred further development, at least one sliding spring acts between the anti-lifting safeguard and the cross member engaging under it. The advantages associated with the use of a sliding spring, described in the foregoing in connection with a curved bracket-shaped anti-lifting safeguard, are also equally applicable here and therefore will not be reiterated at this place.

According to another preferred further development of the invention, the bridging device is characterized in that a first of the two plate portions of the at least one plate can be replaced without simultaneous replacement of a second plate portion of the at least one plate. Thereby the mutually independent replacement of individual portions of the bridging device is made possible, which in practice leads to the advantage that not all driving lanes used by the traffic have to be closed simultaneously in the course of possibly necessary replacement of a bridging device, but instead that they can be closed individually and in succession. Thereby the impacts of such replacement on the use of the edifice by traffic can be significantly reduced.

In a particularly preferred further development, the inventive bridging device is characterized in that at least one of the two edifice parts comprises a concrete structure and in that the first plate portion of the at least one plate can be replaced without intervention into the concrete structure. Quite particularly advantageously, the cross members spanned by this plate portion may then also be replaced if necessary during the replacement of the first plate portion without the need to intervene into the concrete structure. In other words, the replacement of a portion of the bridging device may take place without any intervention (e.g. of cutting nature) into the concrete structure of the edifice, whereby the time needed and the working effort for such replacement can be significantly reduced and fewer demands are made on the building material of the edifice. Thereby the impacts of the replacement of a bridging device on the traffic traveling over the edifice is again significantly reduced and the costs caused by the replacement are again lowered.

Another preferred further development of the invention is characterized in that a cross member overlapping with the vertical projection of the butt joint is constructed as a solid structure. Compared with a non-solid cross member, typically constructed as an H-beam, a solid cross member is much flatter for the same load-bearing ability. In this way, the entire bridging device may be constructed in much flatter form which, depending on the specific installation conditions, may represent a great advantage and may open up a further spectrum of service for the bridging device. This advantage is particularly applicable when the two plate portions joined above the cross member in question are joined with one another by means of a curved bracket (see above) engaging around the cross member.

According to another preferred further development of the invention, the bridging device is characterized in that the two plate portions joined with the strap are sealed in liquid-tight relationship with one another by means of a sealing member, which is disposed in their common butt joint and which particularly preferably consists at least predominantly of butyl rubber.

In view of increasing the reliability as well as the useful life of bridging devices, it is entirely common to provide seals between two plates adjacent in cross-member direction; in this way it is possible to prevent corrosive fluids as well as soiling from penetrating between the plates and impairing the functioning of the entire system. Due to the sealing, by means of a sealing member, of the butt joint between the two plate positions joined with a strap, it is accordingly possible to prevent corrosive fluids as well as soiling from being able to penetrate more deeply through the butt joint into the bridging device, which—as already indicated—has positive impacts on its useful life as well as functional capability.

A particularly preferred further development of the inventive bridging device is characterized in that the sealing member can be applied unilaterally on the end side, to be sealed, of one of the two plate portions before the two plate portions are joined to one another in situ. Thereby, when the width of the unloaded, elastic sealing member is chosen to be somewhat larger than the width of the butt joint, it can be ensured that the sealing member is securely clamped between the two plate portions after the two plate portions have been joined to one another, thus improving the sealing effect still further.

Alternatively to this, another further development of the invention is characterized in that the sealing member can be injected into the butt joint after the two plate portions have been joined to one another in situ. Depending on the specific circumstances on the respective construction site, this sealing variant may be advantageous; thus the spectrum of service of the bridging device can be expanded.

As is common for plate-type bridging devices as well as obvious for the person skilled in the art, additional noise-reducing layers, such as toothed plates, sinusoidal plates, for example, may be attached above the at least one plate.

BRIEF DESCRIPTION OF THE DRAWING

In the following, exemplary embodiments of the invention will be explained in more detail with reference to the drawings, wherein.

DETAILED DESCRIPTION OF THE PREFERRED EMBODIMENTS

Figure 1:
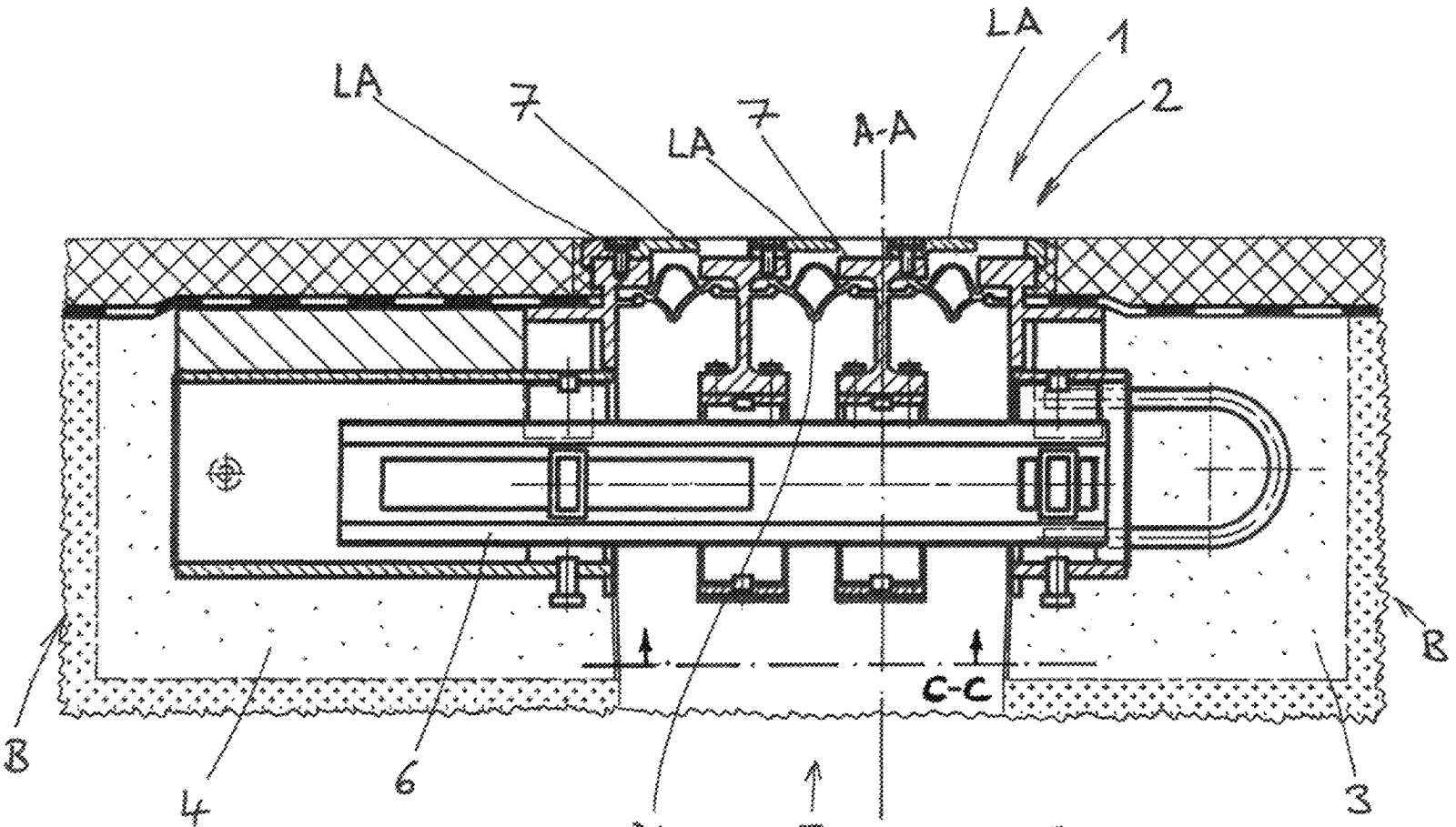
FIG. 1 shows roughly schematically an expansion-joint bridging device positioned between two edifice parts.
Figure 5:
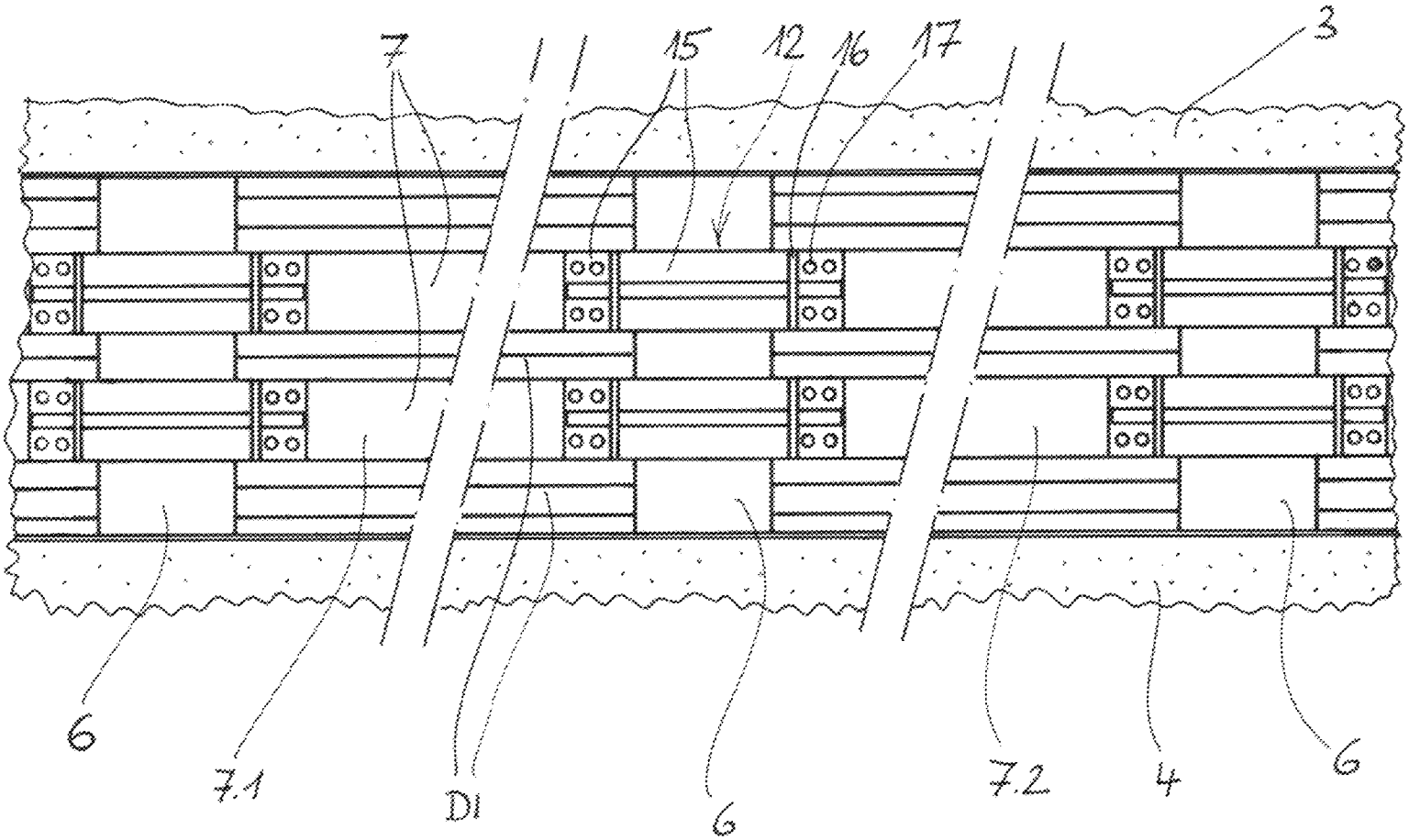
FIG. 5 shows a bottom view of the expansion-joint bridging device of FIG. 1 taken along cut line C-C of FIG. 1.

As can be seen in FIG. 1, expansion-joint bridging device 1 in the form of a plate-type roadway transition 2 bridges over expansion joint 5 between the two edifice parts 3, 4 of a drivable edifice 8. This expansion joint 5 is spanned by at least three cross members 6, each visible in FIG. 5, which are braced in load-bearing relationship on two edifice parts 3, 4 respectively comprising a concrete structure B. One of the load-bearing bracing elements of one of each cross members 6 permits a shifting movement of the respective cross member 6 relative to edifice part 3, 4 in question, in order to ensure that bridging device 1 becomes adapted to the variable width of expansion joint 5. Plates 7 disposed above cross members 6 are braced on cross members 6. In FIG. 1, noise-reducing layers LA are disposed above plates 7. This seal DI is situated in cross-member direction between plates 7.

Figure 2:
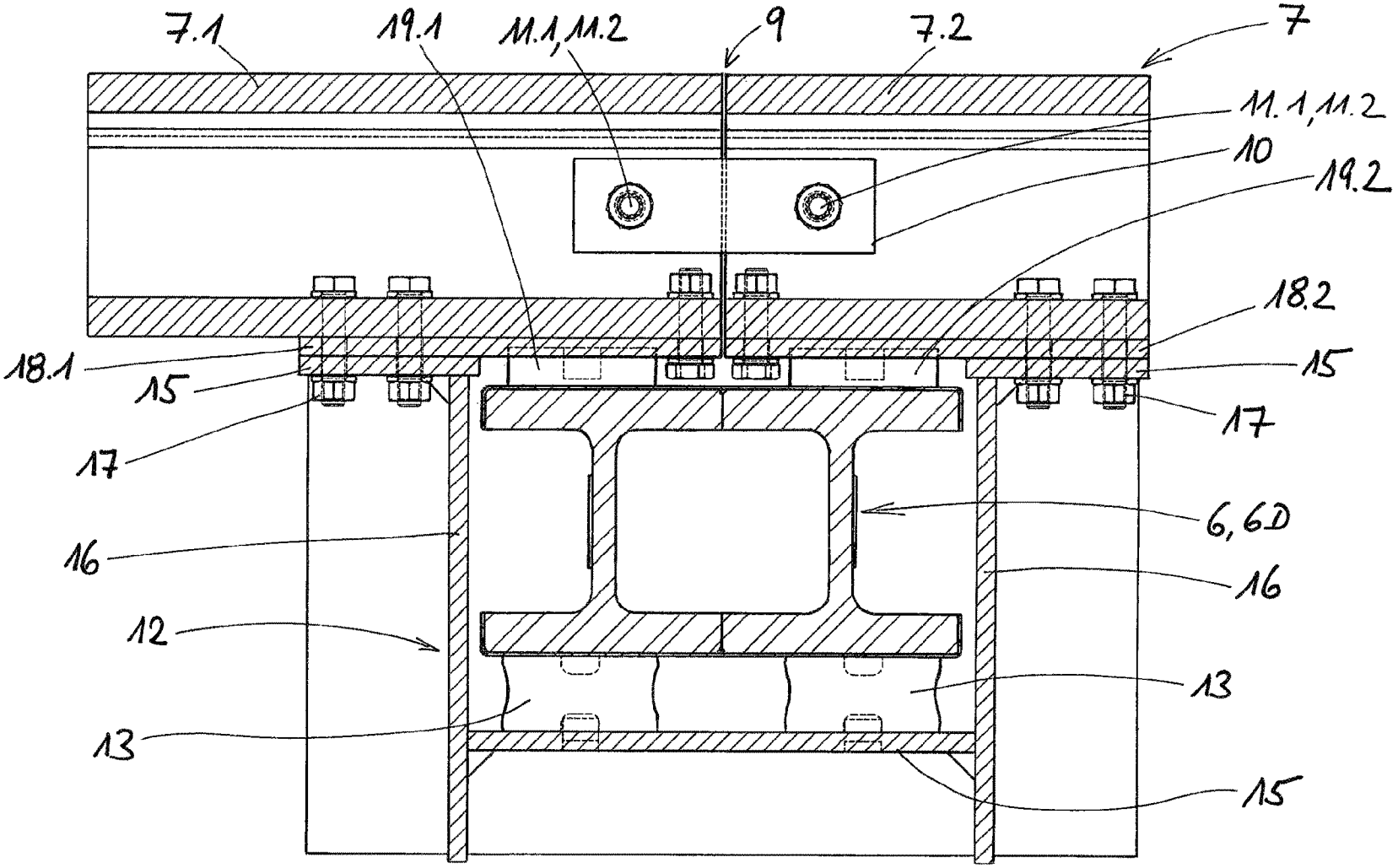
FIG. 2 shows an expansion-joint bridging device with curved bracket-shaped anti-lifting safeguards along section A-A according to FIG. 1.

FIG. 2 shows that plate 7 comprises two plate portions 7.1, 7.2 flush with one another and joined to one another in force-transmitting relationship, wherein the force-transmitting joint of plate portions 7.1, 7.2 takes place by means of strap 10. This strap 10 bridges over butt joint 9 present between plate portions 7.1, 7.2; its vertical projection overlaps with a cross member 6, which is constructed as double cross member 6D, by comprising two H-beams welded to one another.

Both joints of strap 10 with plate portions 7.1, 7.2 are constructed with the ability to pivot with respectively one rotational degree of freedom around an axis extending horizontally and transversely relative to the orientation of plate 7 in question. Threaded bolts 11.1 secured with nuts as well as lock nuts then act as joining means 11.2, wherein the screwed joint formed by them is constructed in such a way that no friction is established between strap 10 and plate portions 7.1, 7.2 that could hinder their rotation relative to one another.

Both plate portions 7.1, 7.2 are additionally joined to one another by means of a curved bracket 12, which functions as an anti-lifting safeguard and engages around the bottom of cross member 6 provided underneath butt joint 9 (see FIG. 2).

This curved bracket 12 comprises three horizontally aligned profile sections 15 and two vertically aligned profile sections 16. Joining of curved bracket 12 with both plate portions 7.1, 7.2 then takes place by means of threaded bolts 17 secured with nuts, wherein respectively one mounting plate 18.1, 18.2 associated with a plate portion 7.1, 7.2 is attached between two horizontally aligned profile sections 15 belonging to curved bracket 12 and the two plate portions 7.1, 7.2. A sliding member 19.1, 19.2 respectively associated with one mounting plate 18.1, 18.2 and joined with it acts between each of the two mounting plates 18.1, 18.2 and cross member 6. At least one sliding spring 13 acts, underneath cross member 6, between curved bracket 12 and cross member 6 engaging around it. Beyond this, although also not illustrated in FIG. 2, sliding members are likewise disposed between vertically aligned bracked 12 and cross member 6 (see FIG. 2).

Figure 3:
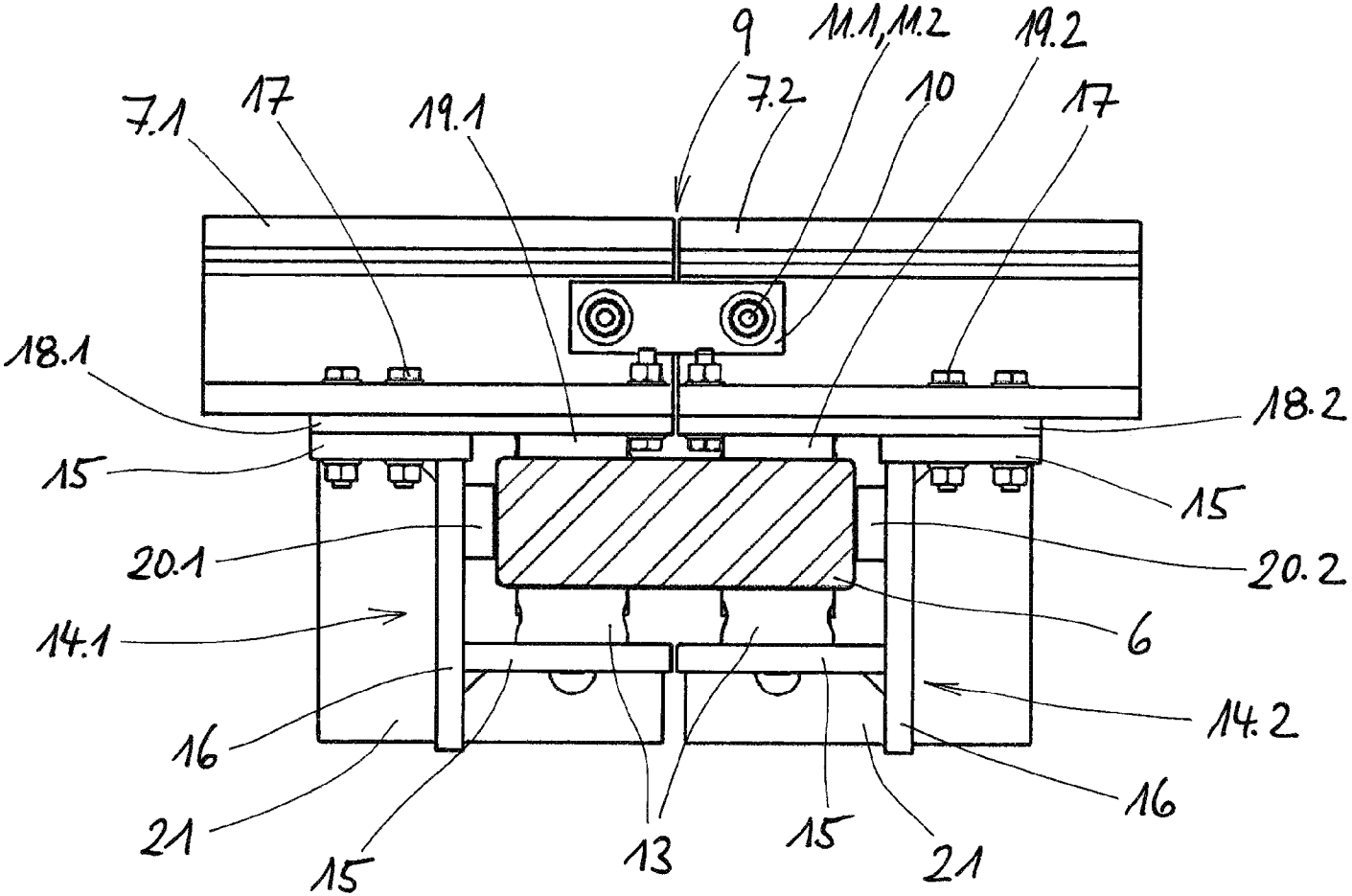
FIG. 3 shows another embodiment of an expansion-joint bridging device with L-shaped anti-lifting safeguards along section A-A according to FIG. 1.
Figure 4:
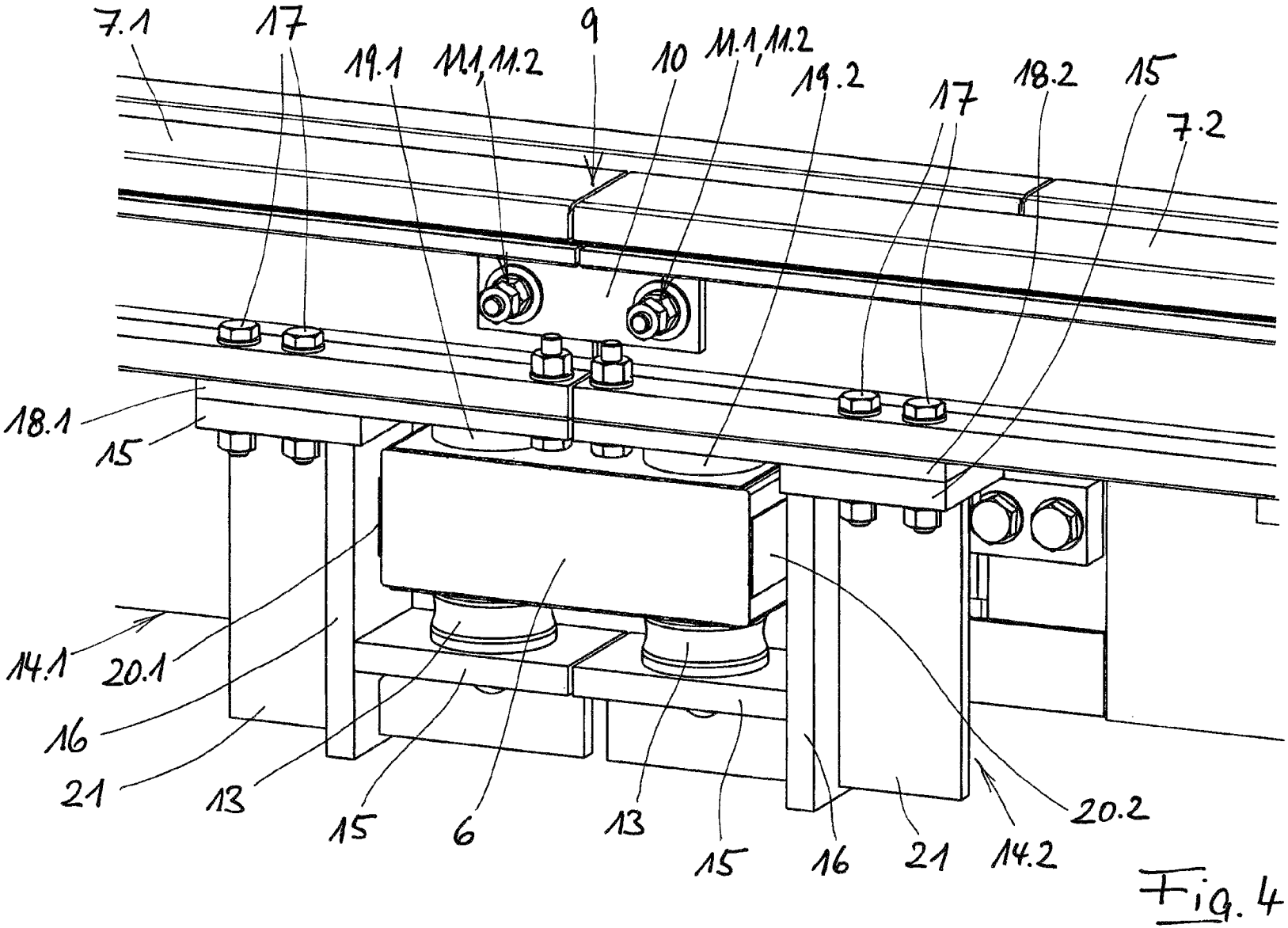
FIG. 4 shows the oblique view of the expansion-joint bridging device from FIG. 3.

In contrast to FIG. 2, FIG. 3 and FIG. 4 show an expansion-joint bridging device 1 with two L-shaped anti-lifting safeguards 14.1, 14.2, which respectively are associated with a plate portion 7.1, 7.2 and engage under the cross member 6, designed as a solid structure, situated closest to the butt joint and bracing plate portions 7.1 and 7.2 in question. These L-shaped anti-lifting safeguards 14.1, 14.2 respectively comprise two horizontally aligned profile sections 15, one vertically aligned profile section 16 and one stiffening plate 21. Joining of L-shaped anti-lifting safeguards 14.1, 14.2 with the associated plate portions 7.1, 7.2 then takes place by means of threaded bolts 17 secured by means of nuts. Thus, between a first horizontally aligned profile section 15 belonging to anti-lifting safeguard 14.1, 14.2 and the associated plate portion 7.1, 7.2, respectively one mounting plate 18.1, 18.2 associated with this is disposed. A sliding member 19.1, 19.2 respectively associated with one mounting plate 18.1, 18.2 and joined with it acts between each of the two mounting plates 18.1, 18.2 and cross member 6. At least one sliding spring 13 acts, respectively underneath cross member 6, between anti-lifting safeguard 14.1, 14.2 and cross member 6 engaging around by it. Respectively one sliding member 20.1, 20.2 is disposed between vertically aligned profile sections 16 and cross member 6.

What is claimed is:

1. An expansion-joint bridging device (1) in the form of a plate-type roadway transition (2), which bridges over an expansion joint (5) present between two edifice parts (3, 4) of a drivable edifice (8), having the following features:

the expansion joint (5) is spanned by at least three cross members (6), each braced in a load-bearing relationship on both edifice parts (3, 4), wherein at least one load-bearing bracing element permits a shifting movement of a corresponding cross member relative to a corresponding edifice part;

at least one plate (7) disposed above the cross members (6) is braced on the cross members (6);

the at least one plate (7) comprises two plate portions (7.1, 7.2) joined flush with one another in a mutually force-transmitting relationship;

the joining of the plate portions (7.1, 7.2) is by at least one strap (10) bridging over a butt joint (9) present between the plate portions (7.1, 7.2) and joined in a force-transmitting relationship with both plate portions (7.1, 7.2); and at least one of two joints of the strap (10) with the plate portions (7.1, 7.2) is pivotable with one rotational degree of freedom around an axis extending horizontally and transversely relative to the orientation of the corresponding plate (7).

2. The device of claim 1, wherein both joints of the strap (10) with the plate portions (7.1, 7.2) are pivotable with each joint having one rotational degree of freedom around parallel axes.

3. The device of claim 1, wherein the butt joint (9) in vertical projection overlaps with one of the cross members (6).

4. The device of claim 3, wherein the cross member (6) overlapping with the vertical projection of the butt joint (9) is a double cross member (6D).

5. The device of claim 3, wherein the cross member (6) overlapping with the vertical projection of the butt joint (9) is a solid structure.

6. The device of claim 3, wherein both plate portions (7.1, 7.2) are joined to one another by a curved bracket (12), which engages a bottom of the cross member (6) underneath the butt joint (9).

7. The device of claim 6, wherein at least one sliding spring (13) acts between the curved bracket (12) and the corresponding cross member (6).

8. The device of claim 1, wherein an L-shaped anti-lifting safeguard (14.1, 14.2) is joined with at least one of the plate portions (7.1, 7.2), such that the L-shaped anti-lifting safeguard engages under one of the cross members (6) located closest to the butt joint (9) and bracing the corresponding plate portion (7.1, 7.2).

9. The device of claim 8, wherein at least one sliding spring (13) acts between the anti-lifting safeguard (14.1, 14.2) and the corresponding cross member (6).

10. The device of claim 1, wherein a first plate portion (7.1) of the at least one plate (7) is replaceable independent of a second plate portion (7.2) of the at least one plate (7).

11. The device of claim 10, wherein at least one of the two edifice parts (3, 4) comprises a concrete structure and in that the first plate portion (7.1) of the at least one plate (7) is replaceable without intervention into the concrete structure (B).

12. The device of claim 1, wherein the two plate portions (7.1, 7.2) joined with the strap (10) are sealed in a liquid-tight relationship by a sealing member, which is disposed in their common butt joint (9).

13. The device of claim 12, wherein the sealing member comprises butyl rubber.

* * * * *